US007098568B2

(12) United States Patent
Zilch

(10) Patent No.: US 7,098,568 B2
(45) Date of Patent: Aug. 29, 2006

(54) CURRENT-TRANSFER ASSEMBLY

(75) Inventor: Peter Zilch, Berlin (DE)

(73) Assignee: Schunk Metall und Kunststoff GmbH, Wettenberg (DE)

( * ) Notice: Subject to any disclaimer, the term of this patent is extended or adjusted under 35 U.S.C. 154(b) by 246 days.

(21) Appl. No.: 10/470,274

(22) PCT Filed: Feb. 6, 2002

(86) PCT No.: PCT/EP02/01211

§ 371 (c)(1),
(2), (4) Date: Feb. 27, 2004

(87) PCT Pub. No.: WO02/063727

PCT Pub. Date: Aug. 15, 2002

(65) Prior Publication Data

US 2004/0130230 A1 Jul. 8, 2004

(30) Foreign Application Priority Data

Feb. 8, 2001 (DE) ..... 101 06 119

(51) Int. Cl.
*H01R 39/08* (2006.01)

(52) U.S. Cl. ..... 310/232; 310/237

(58) Field of Classification Search ..... 310/232, 310/237, 239; 174/72 C, 152 G, 153 R, 174/153 G, 154, 151
See application file for complete search history.

(56) References Cited

U.S. PATENT DOCUMENTS 633,972 A * 9/1899 Lamme ..... 310/232
661,227 A * 11/1900 REist et al. ..... 310/232
919,547 A * 4/1909 Dawson ..... 310/232
1,339,988 A * 5/1920 Steinberger ..... 310/232
1,731,892 A * 10/1929 Ferris ..... 310/232
1,756,004 A * 4/1930 Barr et al. ..... 310/232
2,404,969 A * 7/1946 Liddington ..... 310/232
2,920,300 A * 1/1960 Oetzel et al. ..... 439/23
3,548,232 A * 12/1970 Foerste et al. ..... 310/232
3,579,006 A * 5/1971 Kindl et al. ..... 310/227
4,406,961 A * 9/1983 Pfluger et al. ..... 310/232
4,465,951 A * 8/1984 Dalby ..... 310/114
6,400,057 B1 * 6/2002 Vesper et al. ..... 310/232

FOREIGN PATENT DOCUMENTS

| | | |
|---|---|---|
| DE | 932810 | 9/1955 |
| DE | 1916263 | 1/1970 |
| DE | 1904099 | 8/1970 |
| DE | 2510578 | 9/1975 |
| DE | 2443769 | 3/1976 |
| DE | 258687 | 7/1988 |
| DE | 2650445 | 2/1991 |
| FR | 2650445 | 2/1991 |
| JP | 57199450 A * | 12/1982 |

* cited by examiner

*Primary Examiner*—Darren Schuberg
*Assistant Examiner*—Yahveh Comas
(74) *Attorney, Agent, or Firm*—Dennison, Schultz & MacDonald

(57) ABSTRACT

A current-transfer assembly for electric machines, including a shaft (22) with electrically conductive slip elements (13, 14, 16, 18) originating from and coaxially surrounding the shaft, the elements supporting carbon brushes. According to the invention, various electric phases are connected to slip elements that are insulated from one another, by means of current paths that lead to the windings of the electric machine. To guarantee that temperature fluctuations do not adversely affect the current transfer, the slip elements are configured as disc elements that consist of or contain carbon material.

20 Claims, 4 Drawing Sheets

CURRENT-TRANSFER ASSEMBLY

Figure 2:
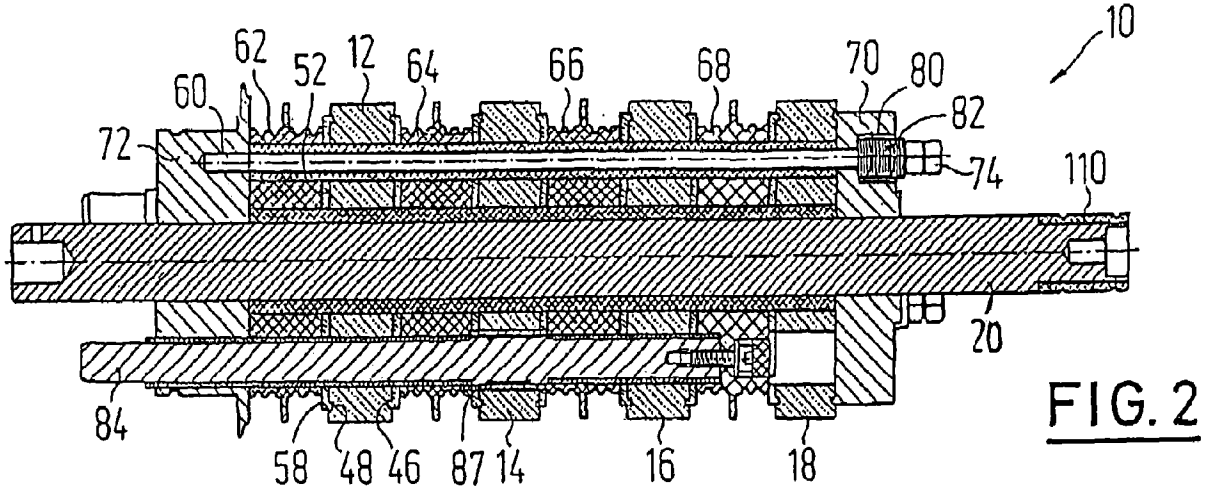

The invention relates to a current-transfer assembly for electric machines, especially generators of e.g. wind power plants, comprising a shaft with electrically conductive slip elements originating from and coaxially surrounding said shaft, said elements supporting contact elements such as carbon brushes, wherein various electric phases are connected to slip elements that are insulated from one another, by means of current paths that lead to the windings of the electric machine, e.g. conductor pins or conductor rods.

In electric machines such as generators or electric motors, current can be transferred via slip rings to carbon brushes, which are supported by said rings. Generally slip rings made of metal are used, which determines the abrasion of the carbon brushes. In order to reduce abrasion, the carbon brushes can be impregnated.

Familiar slip ring configurations for electric machines are revealed e.g. in DE 23 43 769 C2, DE-PS 875 235, DD 248 909 A1, DE 32 30 298 A1 or DE-AS 1 184 412.

In large electric machines such as generators in wind power stations it must be ensured that on one hand abrasion is kept to a minimum and that on the other hand easy handling is guaranteed in case of maintenance work or the replacement of elements.

If carbon slip rings are used in familiar systems, they are fixed on a base carrier by means of adhesion, by shrinkage or by clamping. Since the carbon and the carrier exhibit different coefficients of expansion, safe current transfer is not guaranteed in all cases. Additionally, glued and shrunk connections do not ensure longevity. The familiar clamping connections moreover require additional screw assemblies in order to achieve even surface pressure. This is quite a complex process especially in the area of carbon slip ring systems.

Independent thereof it must be ensured that carbon dust generated by abrasion does not lead to short circuits. Since in the familiar configuration the shaft is seated on one end, extensive guidance and seating is required with regard to the design in order to ensure the desired vibration stability.

It is the object of the present invention to further develop a current-transfer assembly of the above-described kind such that safe current transfer is guaranteed at all times. Pursuant to another aspect it shall be ensured that the assembly exhibits high vibration stability. It shall create with simple design measures the possibility of performing a modification of the current-transfer areas. Furthermore it shall ensure that developing carbon dust does not impair electrical functionality.

To resolve the main problem of the object of the invention it is provided that the slip elements are disc elements consisting of carbon material or containing it.

Deviating from previously known designs, it does not employ a carbon slip ring that is attached to a carrier. Rather a disc element consisting of a uniform material is used, wherein said element can consist of conventional materials that are used for transferring currents such as carbon, graphite, carbon graphite or metal graphite. Since the disc element consists of a uniform material, no different coefficients of expansion that would lead to an impairment of the current transfer can occur.

In particular, and in a further development of the invention that should be emphasized, it is provided that the disc element is equipped with perforations, wherein a bushing that protrudes on both lateral surfaces of the disc element is inserted in at least one perforation with snug fit. The at least one bushing guides one of the current pins or current rods, via which the current is supposed to be transferred by means of the carbon disc.

Furthermore it is provided that along each lateral surface of the disc element runs a contact plate, which comprises perforations, consists of electrically conductive material and rests against the lateral surface, wherein said perforations are interspersed with one of the bushings or peripheral face sections of said bushing protruding beyond said lateral surfaces. Hereby the peripheral face sections of the bushing are fitted, such as pressed, into the perforations of the contact plates.

In other words, it is provided pursuant to the invention that the bushing, consisting e.g. of copper, is fitted with an exactly defined snug fit into the disc element consisting of carbon material. The bushing protrudes on either side of the disc element by a certain dimension, which corresponds in its thickness of the plate element—also called flanged plate. The plate elements or flanged wheels are then pressed onto the protruding sections of the bushing on both sides with the same bore pattern and fit dimension.

Of course also more than one bushing can be fit, especially snug fit, into one flanged wheel.

Moreover it is provided that the contact plate comprises a peripheral angled edge, which engages a corresponding peripheral groove in the lateral surface of the disc element.

The sleeves or bushings and/or the contact plates should consist of copper or contain it. Furthermore it is provided that the disc element in the contact area with the bushing or the bushings and/or contact plates is equipped with electrically conductive material, e.g. is copper-plated, in particular coated by spray-coppering. This guarantees additionally a safe current transfer.

In order to ensure sufficient electrically conductive contact between the current-transferring conductor pins or rods and the bushings, another suggestion of the invention provides for the current-transferring conductor pins or rods to be connected via collector contacts with the bushings, via which a current transfer to the disc element is performed.

The idea pursuant to the invention causes a defined and temperature-independent current transfer at the lowest transition resistance values from the contact or carbon brush running surface via the preferably copper-plated lateral surfaces of the disc element such as the carbon disc to the plate elements such as flanged plates, the pressed-in bushing, which preferably consists of copper, and via the collector contact to the current transfer pins or the current transfer rod. This way, even with heavily fluctuating loads and hence large temperature fluctuations, it is guaranteed in the contact disc that a defined current transfer occurs consistently.

Pursuant to another suggestion of the invention, for which separate protection is being sought, it is provided that the intermediate space between the disc elements connected with various electric phases is covered across its entire surface. In particular, the intermediate space is covered by an insulating body that comprises peripheral ribs on the circumference.

The ribs can hereby have different diameters, wherein in particular one rib runs in the center area of the insulating body, with a diameter that is larger than the diameters of the remaining ribs. This forms a kind of separating wall, which additionally ensures that carbon dust cannot cause electric malfunctions. The insulating body as such consists in particular of synthetic material such as glass fiber resin insulating material.

The idea pursuant to the invention is also characterized by a suggestion, which is covered by separate protection, that the shaft is seated on both sides, especially in its respective end regions. The shaft can be seated in face walls of a housing, which accommodates the current-transfer assembly. The housing can moreover comprise a heat exchanger such as a surface cooling unit. Hereby, lines leading to the heat exchanger can be connected with a cooling circuit of the electric machine itself. Alternatively it is possible to connect the lines with an internal cooling circuit. In this respect, however, we would like to point out sufficient cooling systems.

Finally, the invention is also characterized by the independent idea that a unit comprising the shaft, the disc elements and the conductor pins or rods has a modular design. One phase of the electric machine can be connected with several disc elements that are arranged directly next to one another on the shaft. This way a system is made available, which can be used for several current-transfer areas. E.g. one disc element per phase, respectively, can be used for current transfers of 500 A, while e.g. with a current transfer of 800 A two disc elements per phase, respectively, are arranged on the shaft.

The idea of the invention makes a current-transfer assembly particularly for wind generators available, which offers a long operational life and thus minimized maintenance and service times. The contact disc is completely replaceable and can be regenerated. The enclosed design, i.e. covering the intermediate areas between the contact discs completely, enables a compact design of the assembly, which overall leads to a cost reduction especially for the additionally required assemblies such as cooling system and housing.

Further details, benefits and features of the invention are revealed not only in the claims and the features contained therein—either alone and/or in combination—but also in the following description of the preferred embodiments disclosed in the drawing.

Figure 1:
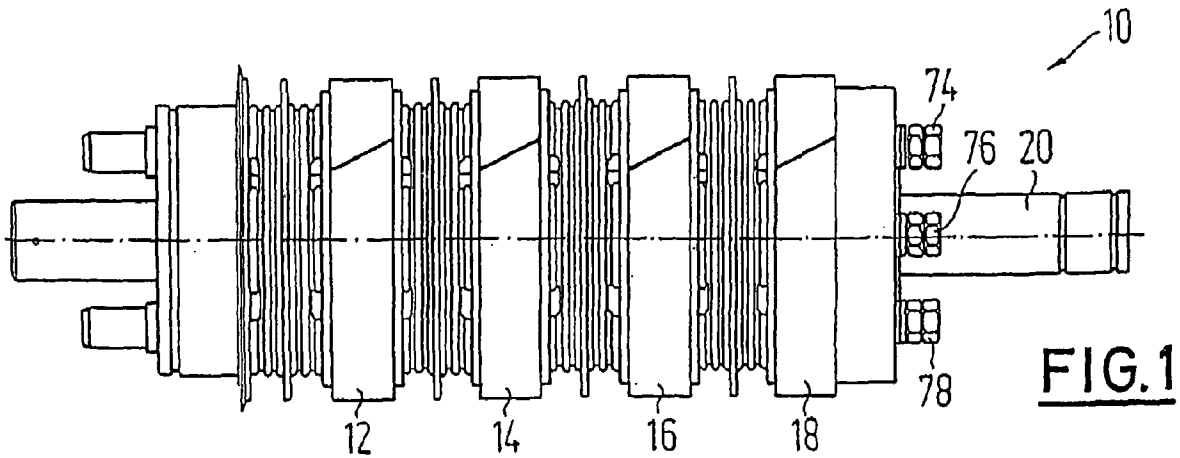
Figure 3:
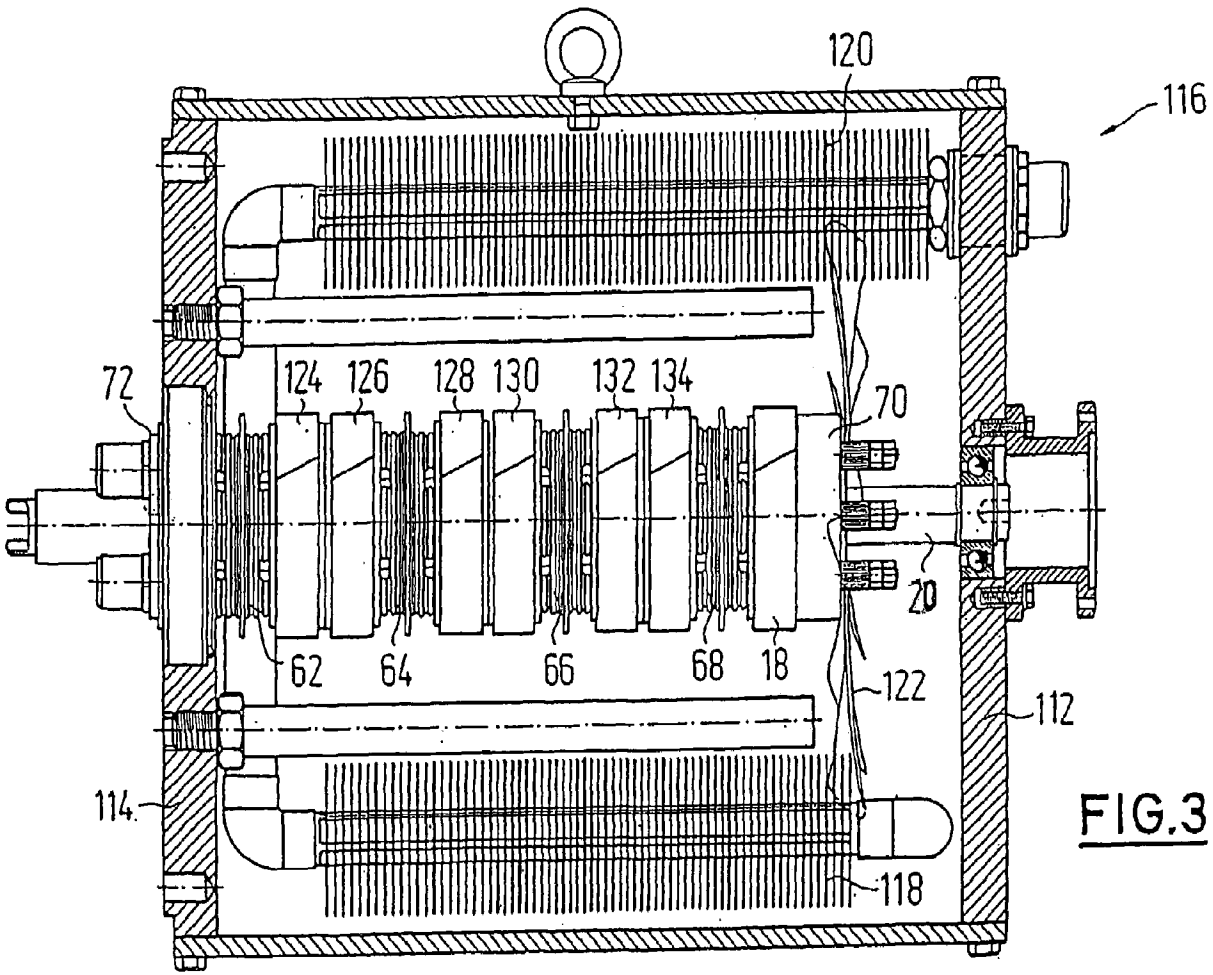
Figure 4:
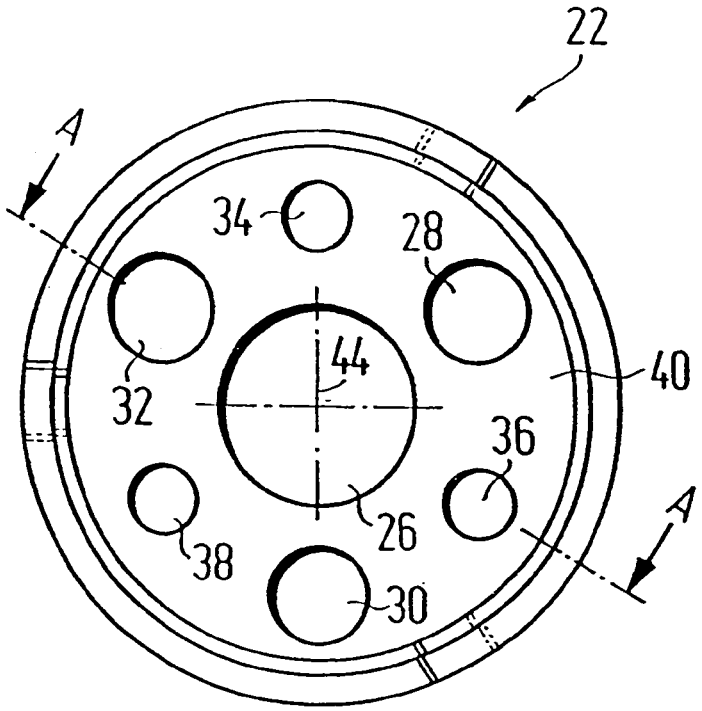
Figure 6:
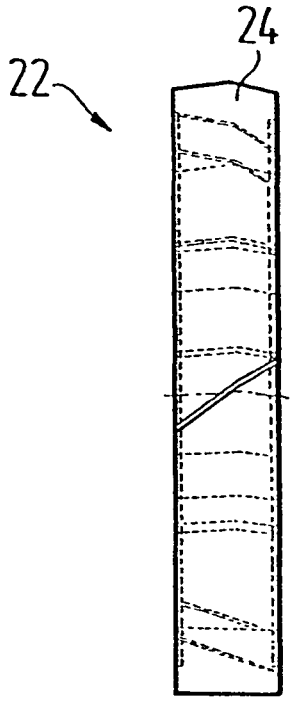
Figure 5:
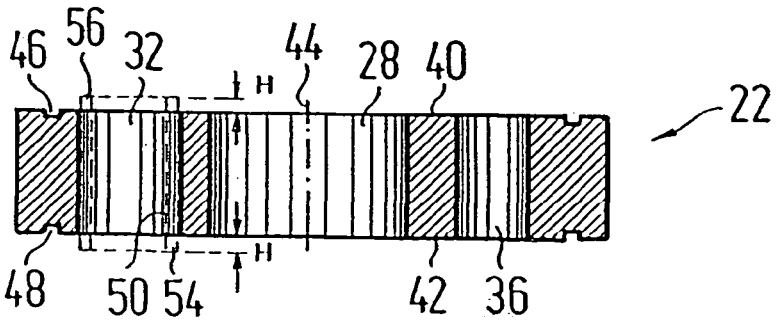
Figure 7:
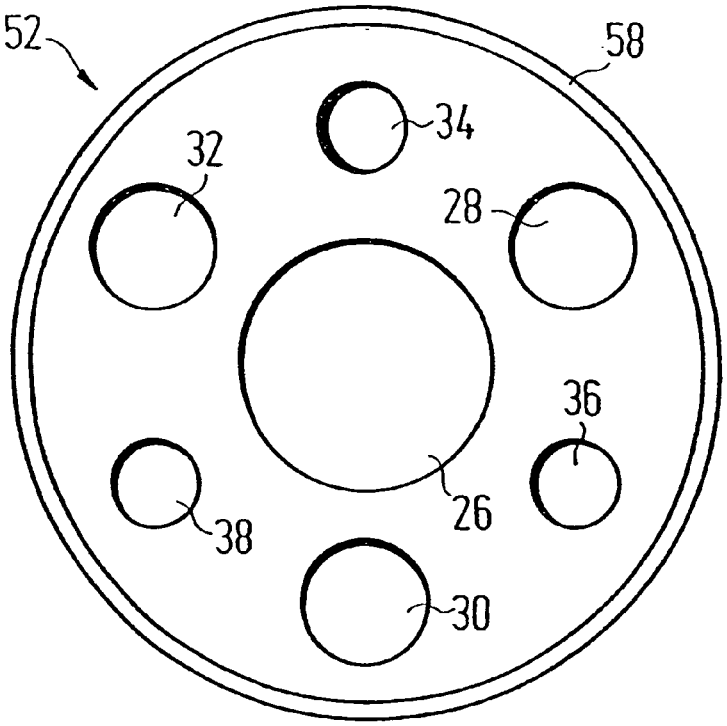
Figure 8:
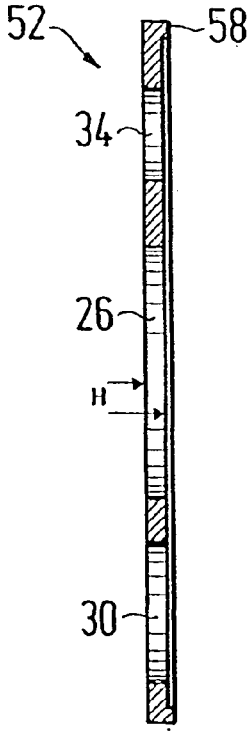
Figure 9:
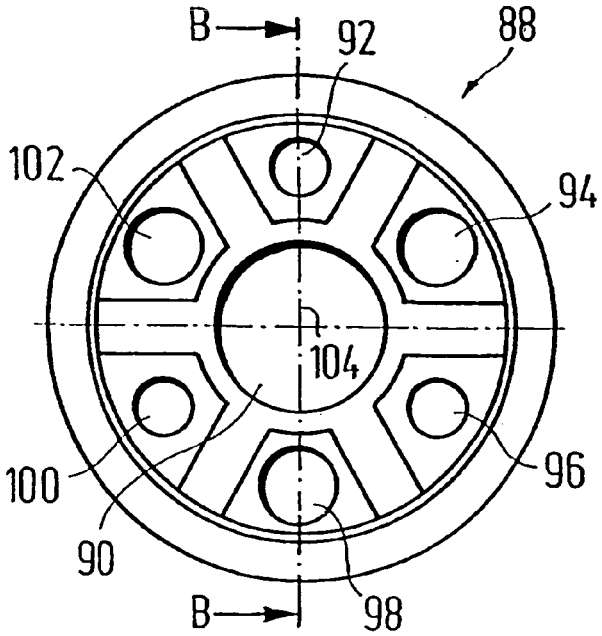
Figure 10:
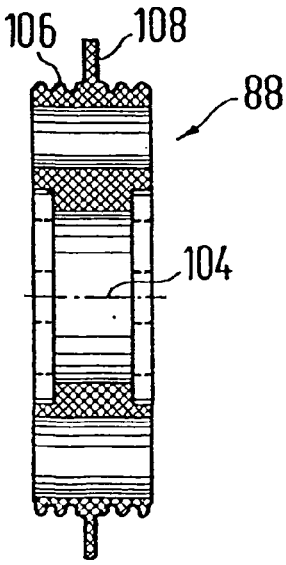

The following is shown:

FIG. 1 a side view through a current-transfer assembly of an electric machine, FIG. 2 the current-transfer assembly pursuant to FIG. 1 in a longitudinal sectional view, FIG. 3 a basic depiction of a current-transfer assembly that is arranged in a housing, FIG. 4 side view of a slip element, FIG. 5 a sectional view along the line A—A in FIG. 4, FIG. 6 a top view onto the slip element pursuant to FIG. 4, FIG. 7 a side view of a plate element, FIG. 8 a cross-sectional view through the plate element pursuant to FIG. 7, FIG. 9 a side view of an insulating body, and FIG. 10 a sectional view along the line B—B from FIG. 9.

The figures describe elements of a current-transfer assembly for a generator of a wind power station, without hereby limiting the invention. The idea pursuant to the invention rather also applies to other current-transfer assemblies that are determined for electric machines.

In order to transfer the power or current that is generated in the windings of a generator, a current-transfer assembly is provided, which comprises a slip element device 10, which transfers current in the familiar fashion via carbon brushes, which are not depicted. In the embodiment a three-phase generator is shown, in which phases T, S and R are connected with a slip element 12, 14, 16, respectively. The remaining fourth slip element 18 is the zero conductor, which has mass potential, i.e. the potential of a shaft 18, from which the slip elements 12, 14, 16, 18 originate.

Pursuant to the invention, the slip elements 12, 14, 16, 18 are disc elements made of carbon material such as graphite, carbon graphite, metal graphite or other carbon materials known in the field of current transfer.

A corresponding disc element—called a carbon disc in the following in a simplified form—is depicted in FIGS. 4 through 6. The carbon disc 22 has a cylindrical shape, wherein its circumferential surface 24 represents a contact or sliding surface for a carbon brush, which is not shown, via which current is transferred. The carbon disc can be slotted peripherally, as is known to be the case in conventional slip rings.

The carbon disc 22 comprises perforations—called bores in the following—specifically a central bore 26 for the shaft 20 as well as bores 28, 30, 32 of a first diameter and bores 34, 36, 38 of a diameter preferably deviating thereof.

Furthermore a peripheral groove 46, 48 running concentrically to the carbon disc longitudinal axis 44 is provided in each lateral surface 40, 42 spaced to the sliding surface 24.

In at least one of the bores 28, 30, 32 especially of larger diameter a bushing made of electrically conductive material, especially a copper bushing, is fitted, such as pressed, with an exactly defined snug fit. One bushing 50 is shown with dotted lines in FIG. 5. The corresponding bushing 50 protrudes beyond the respective lateral surface 40, 42 of the carbon disc 22 with a dimension H. On the lateral surfaces 40, 42 of the full carbon disc 22 then a contact plate 52, which can be called a flanged plate, is arranged, respectively, which exhibits the same bore pattern as that of the carbon disc 22 and is pressed with snug fit onto the peripheral sections 54, 46 of the bushing or sleeve protruding beyond the lateral surface 40, 42. The thickness of the contact plate 52 hereby is that of the dimension H of the sleeve 50, by which it protrudes beyond the lateral surfaces 40, 42.

Since the bores of the contact plate 52 agree with those of the carbon disc 22, corresponding reference numbers are used.

Moreover the contact plate 52 comprises a peripheral rail 58 protruding laterally beyond the edge, wherein said rail is adjusted to the groove 46 or 48 in the lateral surfaces 40, 42 of the carbon disc 22 so that in the case of contact plates 52, 54 that rest against the lateral surfaces 40, 42 the angled wheels, i.e. the rail-shaped sections 58, engage the grooves 46, 48.

The bores 34, 36, 38 are then interspersed with electrically conductive fastening or clamping bolts 60 or those that consist of electrically insulating material, via which the slip elements 12, 14, 16, 18 are tightened and tensioned between flange discs 70, 72 with insulating bodies 62, 64, 66, 68 that run between said elements. The fastening pin 60, which comprises a thread at least on the end, originates from one of the flange discs—in the embodiment it is flange disc 72—and is e.g. screwed together with it in order to be tightened on the opposite side by means of screws 74, 76, 78. In order to achieve the necessary pre-stress, a spring element such as a cup spring configuration 82 is arranged between the screws 74, 76, 78 and the bottom surface of a recess 80 contained in the flange disc 74 containing the pin 60.

In the example bores 28, 30, 32 of larger diameter comprise current paths in the form of conductor pins 84, wherein one conductor pin 84 leading to one of the phases T, S or R of the windings of the generator, respectively, is connected in an electrically conductive manner with one of the carbon discs 12, 14, 16 and is insulated electrically from the remaining ones. In the example the conductor pin 84 is connected with the carbon disc 14 in an electrically conductive manner. Consequently the corresponding bore contains the snug fit bushing 50, wherein the conductor pin 84 with the bushing 50 is connected in an electrically conductive manner by means of a collector contact 86 as we know it from high-voltage engineering.

The contact discs 12, 14, 16 connected with the phases T, S or R are electrically insulated among each other, in relation to the supporting shaft 20 as well as in relation to the carbon disc 18 connected to mass as well as in the embodiment in relation to the flange disc 72 by means of the insulating bodies 62, 64, 66, 68.

The basic design of the insulating bodies 62, 64, 66, 68 is explained in more detail in FIGS. 9 and 10 based on an insulating body 88. The insulating body 88, which in particular consists of synthetic material such as glass fiber resin insulating material, has a disc shape with perforations 90, 92, 94, 96, 98, 100, 102, which in the case of a mounted slip element body 10 run flush to the bores 26, 28, 30, 32, 34, 36, i.e. containing both the shaft 22 and the fastening pin 60 and the conductor pin 84. On the circumferential side, the insulating body 38 comprises ribs 106, 108 running transversely to its longitudinal axis 104, wherein the rib 108 running in the center area exhibits a larger outer diameter. The center rib 108 hereby represents quasi a separating wall between the adjacent elements having different potentials, i.e. on one hand between the flange disc 72 and the carbon plate 12 and on the other hand between the carbon plates 12, 14, or 14, 16 or 16, 18. Via the insulating bodies 62, 64, 66, 68, both the clamping pins 60 and the conductor pins 84 as well as the shaft 22 are additionally protected in relation to the free surfaces of the carbon plates 12, 14, 16, 18, i.e. in particular their sliding or contact surfaces 24, so that further measures are not required to keep developing carbon dust away. This enables an extremely compact design.

The shaft 22 is seated on both sides, i.e. on one hand towards its free outer end 110 and on the other hand via the flange disc 72. This results in a high level of vibration stability. The shaft 22 or the flange disc 72 can be seated in housing walls 112, 114 on the face side of a housing 116, such as one that is known for wind power stations. Within the housing 116 heat exchangers 118, 120 in the form of plate liquid coolers can be arranged, which can be incorporated either in an internal cooling circuit or in a cooling circuit of the electric machine itself. For better cooling, furthermore a fan wheel 122 originates from the front flange disc 70.

The slip disc device 10 with the full carbon discs 12, 14, 16, 18 and the insulating bodies 62, 64, 66, 68 running in between and the flange discs 70, 72 delimiting this assembly on the face has a noticeable modular design so that it offers the possibility of adding an appropriate number of carbon discs to the shaft 22 as a function of the size of the current being transferred, wherein several carbon discs that are allocated to one of the phases T, S and R are arranged directly adjacent to one another and electrically conductive among each other on the shaft 22. In the embodiment of FIG. 3 for example, phases S, T and R are allocated two carbon discs 124, 126 and 128, 130 and 132, 134, respectively, exhibiting a design as has been described in detail in connection with FIGS. 4 through 8. Between the sets of full carbon discs 124, 126 or 128, 130 or 132, 134 and the adjoining flange disc 72 or the carbon disc 18 connected with the zero conductor, the insulating bodies 62, 64, 66, 68 similar to FIG. 2 are arranged in a configuration pursuant to FIGS. 9 and 10.

The invention claimed is:

1. Current-transfer assembly for electric machines, especially generators of e.g. wind power plants, comprising a shaft (20) with electrically conductive slip elements (14, 128, 132, 134) originating from and coaxially surrounding said shaft, said slip elements supporting contact elements such as carbon brushes, wherein various electric phases are connected to the slip elements that are insulated from one another by means of current paths that lead the windings of the electric machine such as conductor pins or conductor rods (84), wherein the slip elements (12, 14, 16, 18, 22, 124, 126, 128, 130, 132, 134) are disc elements containing carbon material, and the disc element (22) comprise perforations (26, 28, 30, 32, 34, 36, 38); wherein in at least one perforation a bushing (50) consisting of an electrically conductive material is inserted in a snug fit, said bushing (50) protrudes on both lateral surfaces (40, 42) of the disc element (22); wherein each lateral surface (40, 42) of the disc element (22) has a contact plate (52), wherein the contact plates is made of electrically conductive material resting against the lateral surface of the disk element having perforations (26,28, 30, 32, 34, 36, 38) with a bore pattern that corresponds to the perforations of the disc-element, and the bushing (50) with its peripheral face sections (54 , 56) that protrude beyond the lateral surfaces (40, 42) of the disc element (22) at a dimension H is inserted in one of the perforations of the contact plate (52).

2. Current-transfer assembly pursuant to claim 1, characterized in that the peripheral face section (54, 56) of the bushing (50) is fitted, such as pressed, into one of the bores of the contact plate (52).

3. Current-transfer assembly pursuant to claim 1, characterized in that the contact plate (52) has a thickness that corresponds to the dimension H of the respective peripheral face section (54, 56) protruding beyond the lateral surfaces (40, 42) of the disc element (22).

4. Current-transfer assembly pursuant to claim 1, characterized in that the contact plate (52) transitions on the outer surface flush into the face of the bushing (50).

5. Current-transfer assembly pursuant to claim 1, characterized in that the bushing (50) and/or the contact plate (52) consist of copper and/or contain it.

6. Current-transfer assembly pursuant to claim 1, characterized in that the contact plate (52) comprises a peripheral angled edge (58), which engages a corresponding peripheral groove (46, 48) in the lateral surface (40, 42) of the disc element (22).

7. Current-transfer assembly pursuant to claim 1, characterized in that the current-conducting conductor pin or the conductor rod (84) is connected with the bushing (50) by means of a contact, especially a collector contact, via which the current is transferred to the disc element (14).

8. Current-transfer assembly pursuant to claim 1, characterized in that the disc elements (22) in the contact area to the contact plates (52) and/or the bushing (50) are equipped with electrically conductive material, such as are copper-plated, especially coated by spray-coppering.

9. Current-transfer assembly pursuant to claim 1, characterized in that the intermediate space between disc elements (22) that are connected to various electric poles is covered in its entirety.

10. Current-transfer assembly pursuant to claim 1, characterized in that the intermediate space between the disc elements (12, 14, 16, 18) with different electric potentials or to the adjoining element such as a flange disc (72) is covered by an insulating body (62, 64, 66, 68, 88) comprising peripheral ribs (106, 108) on the circumference.

11. Current-transfer assembly pursuant to claim 1, further comprising a plurality of ribs (106, 108) having different diameters and running transversely to the longitudinal axis of the insulating body (88).

12. Current-transfer assembly pursuant to claim 1, characterized in that in the center area of the insulating body (88) a rib extends with a diameter (108) that is larger than the diameter of the remaining ribs (106).

13. Current-transfer assembly pursuant to claim 1, characterized in that the insulating body (88) consists in particular of synthetic material such as glass fiber resin insulating material.

14. Current-transfer assembly pursuant to claim 1, characterized in that the shaft (22) is seated in its respective end areas (110).

15. Current-transfer assembly pursuant to claim 1, characterized in that the disc elements (12, 14, 16, 18) and insulating bodies (62, 64, 66, 68) arranged on the shaft (22) form a unit with modular design.

16. Current-transfer assembly pursuant to claim 1, characterized in that one phase of the electric machine is allocated several disc elements (124, 126, 128, 130, 132, 134) that are arranged directly adjacent to one another on the shaft (22).

17. Current-transfer assembly pursuant to claim 1, characterized in that the shaft (22) and the disc elements (12, 14, 16, 18, 124, 126, 128, 130, 132, 134) as well as the insulating bodies (62, 64, 66, 68) form a unit, which is arranged in a housing (116), in the face walls (112, 114) of which the shaft (22) is seated.

18. Current-transfer assembly pursuant to claim 1, characterized in that within the housing (116) a heat exchanger (118, 120) is arranged.

19. Current-transfer assembly pursuant to claim 1, characterized in that the heat exchanger (118, 120) is a surface cooling device.

20. Current-transfer assembly pursuant to claim 1, characterized in that the heat exchanger (118, 120) is connected with a cooling circuit of the electric machine.

* * * * *